US008056570B2

(12) United States Patent
Tu

(10) Patent No.: US 8,056,570 B2
(45) Date of Patent: Nov. 15, 2011

(54) BOBBY PIN (1)

(75) Inventor: Jui-Ming Tu, Tainan (TW)

(73) Assignee: Tsorng Ta Enterprise Co., Ltd., Tainan (TW)

( * ) Notice: Subject to any disclaimer, the term of this patent is extended or adjusted under 35 U.S.C. 154(b) by 567 days.

(21) Appl. No.: 11/933,880

(22) Filed: Nov. 1, 2007

(65) Prior Publication Data

US 2008/0185015 A1 Aug. 7, 2008

(30) Foreign Application Priority Data

Feb. 6, 2007 (TW) ..... 96202269 U

(51) Int. Cl.
*A45D 8/12* (2006.01)
*A45D 8/00* (2006.01)

(52) U.S. Cl. ..... 132/275; 132/273

(58) Field of Classification Search ..... 132/273, 132/275, 276–279; 63/3.1, 35, 3, 8, 7
See application file for complete search history.

(56) References Cited

U.S. PATENT DOCUMENTS

| | | | | | |
|---|---|---|---|---|---|
| 1,584,205 | A | * | 5/1926 | Zaldo | 224/219 |
| 1,714,732 | A | * | 5/1929 | Schneider | 132/295 |
| 4,581,271 | A | * | 4/1986 | Gordon | 428/67 |
| 5,713,218 | A | * | 2/1998 | McCabe | 63/3.1 |
| 5,893,377 | A | * | 4/1999 | Chen | 132/275 |
| 6,032,680 | A | * | 3/2000 | Lu et al. | 132/275 |

* cited by examiner

*Primary Examiner* — Robyn Doan
(74) *Attorney, Agent, or Firm* — J.C. Patents

(57) ABSTRACT

A bobby pin includes a body composed of bending members, a decorative member, a clamping member and a clamping holed member. The decorative member is provided with plural decoration recesses for placing plural decorations therein, the clamping member is connected to one side of the decorative member, and the clamping holed member is connected to the other side of the decorative member. The clamping member is provided with plural teeth and the clamping holed member is provided with a hole and a clamping rim around the hole. When the bobby pin is to clamp hair, the clamping member is made to bend by means of the bending members and inserted in the hole of the clamping holed member and clamp with the clamping rim with one of the teeth of the clamping member to let the bobby pin form a tubular shape for clamping hair stably.

10 Claims, 10 Drawing Sheets

BOBBY PIN (1)

BACKGROUND OF THE INVENTION

1. Field of the Invention

This invention relates to a bobby pin, particularly to one having a body formed with a clamping member, clamping teeth formed on the clamping member, a clamping hole defined by a clamping rim to correspond to the clamping member. So one of the clamping teeth of the clamping member are optionally combined with the clamping rim so that the bobby pin may be kept to be bent into a tubular shape with a center hole for hair to pass through to be clamped stably in the bobby pin with various quantity of hair.

2. Description of the Prior Art

"Bobby pin" disclosed by a Taiwan patent No. 084216926 is made integral, having a decorative member and a clamping hole formed in one side of the decorative member, an insert hole bored in the clamping hole, and the clamping hole provided with a horizontal groove and a triangular groove. The decorative member has plural clamping teeth on one side, a flat plate portion formed on a side of the clamping teeth, which are of one-way direction. Then the flat plate portion of the decorative member is inserted through the clamping hole, and the clamping teeth are combined with the clamping hole for clamping hair.

The bobby pin disclosed in the Taiwan patent No. 084216926 has a disadvantage that the decorative member should be made thin, hardly making it exclusively decorative. Should it be made thick enough to make it substantively decorative, it is troublesome in use.

A conventional bobby pin available on the market shown in FIGS. 1 and 2 includes a decorative member 10 and an elastic ring 11 fixed under the decorative member 10. Then the elastic ring 11 is used for clamping hair, but its disadvantage is the elastic ring is not easy to clamp hair tightly enough, letting the hair apt to slide out of the ring 11. Therefore a user may be forced to redo it often.

SUMMARY OF THE INVENTION

The bobby pin according to the invention has plural bending members in a body of the bobby pin to enable the body bent into a tubular shape, utilizing clamping teeth of a clamping member to combine with a clamping edge of a clamping holed member for stably clamping hair inside the tubular shape of the bent bobby pin.

One feature of the invention is the body made integral and composed of the plural bending members, to permit the body bent into a tubular shape, overcoming the drawback of rigidity of thick plastic as its material.

A second feature of the invention is a decoration member formed in an intermediate portion of the body, and the decorative member is provided with plural decoration recesses for placing decorations therein for beautifying the bobby pin.

A third feature of the invention is the clamping member formed at one side of the body, and a clamping holed member at the other side of the body; the clamping member is provided with plural clamping teeth and the clamping holed member is provided with a hole with a clamping rim around the hole, so that the clamping member can be combined with the clamping holed member by one of the teeth clamping the clamping rim. Then some hair can be kept clamped in the bobby pin bent in a tubular shape.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
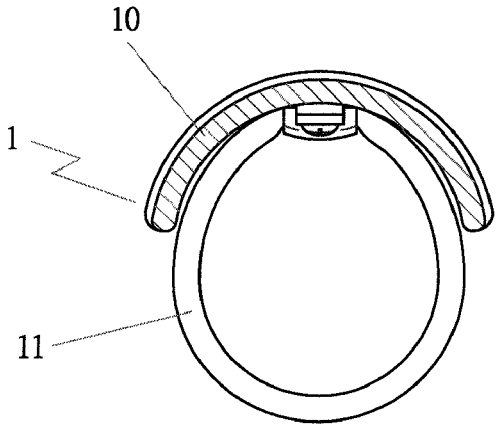
FIG 1 ( PRIOR ART )
FIG. 1 is a cross-sectional view of a conventional bobby pin.
Figure 2:
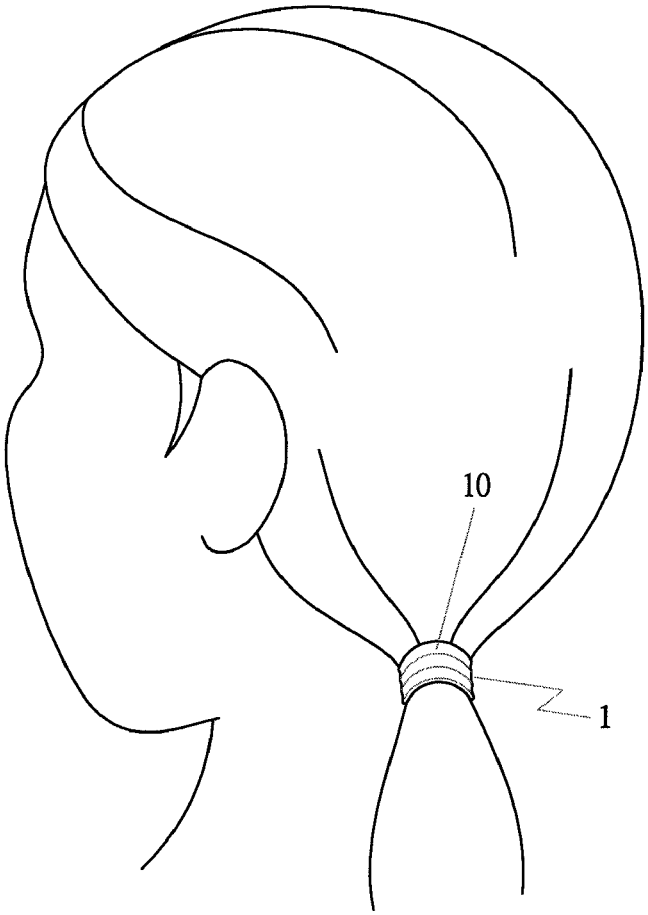
FIG 2 ( PRIOR ART )
FIG. 2 is a perspective view of the conventional bobby pin.
Figure 3:
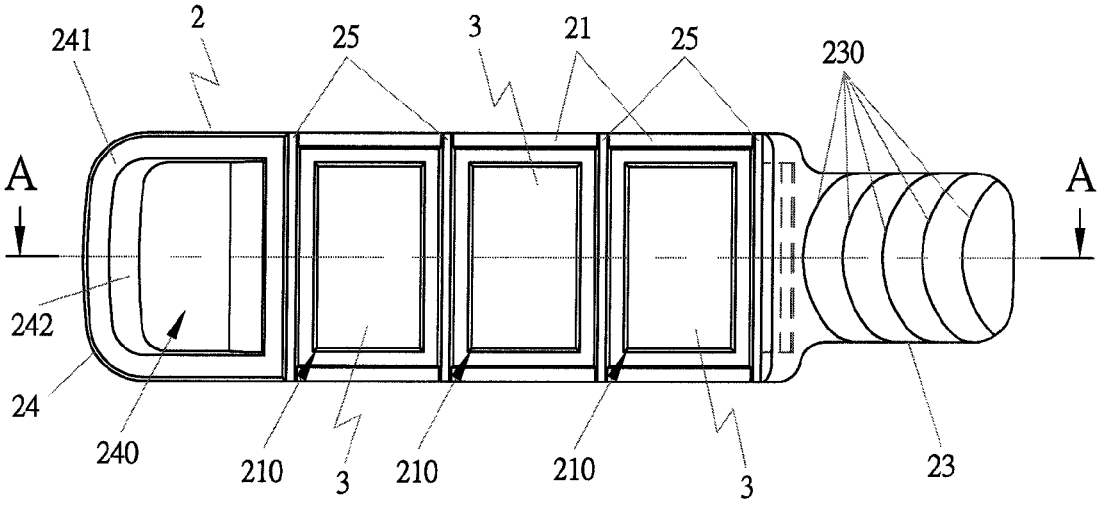
FIG. 3 is an upper view of a first embodiment of a bobby pin in the present invention.
Figure 4:
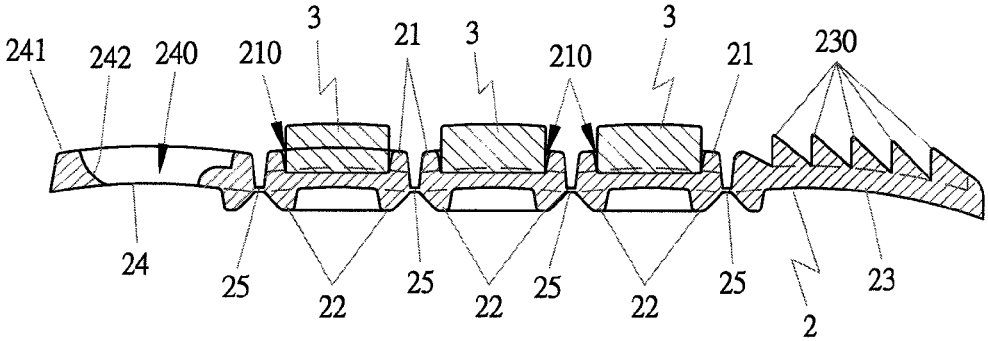
FIG. 4 is a cross-sectional view of the line A-A in FIG. 3.
Figure 5:
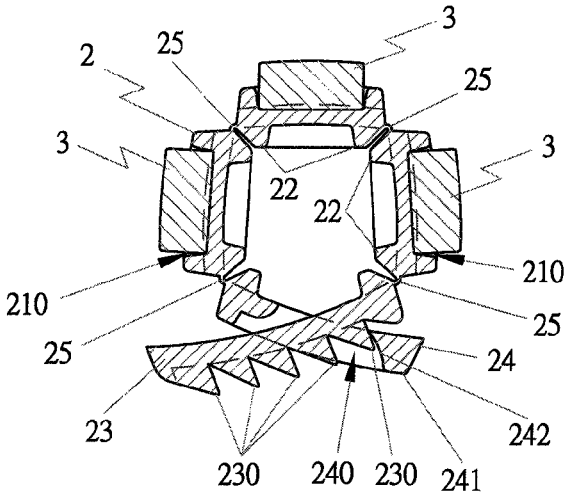
FIG. 5 is a cross-sectional view of the first embodiment of a bobby pin in the present invention.
Figure 6:
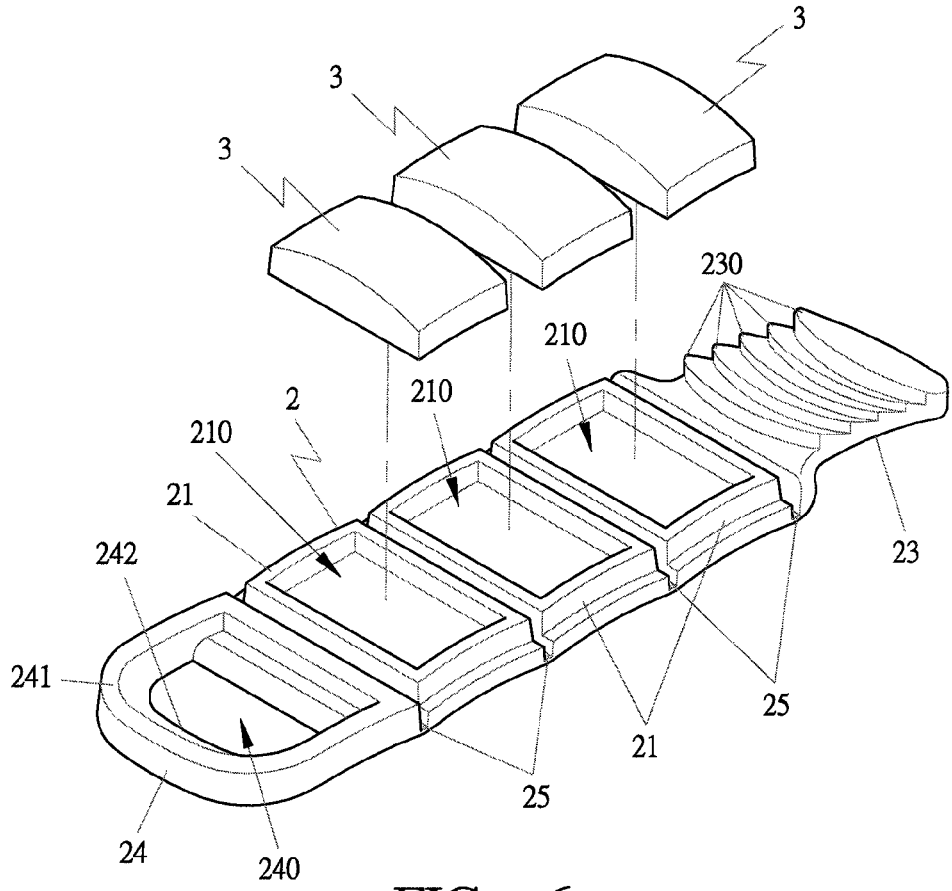
FIG. 6 is an exploded perspective view of the first embodiment of a bobby pin in the present invention.
Figure 7:
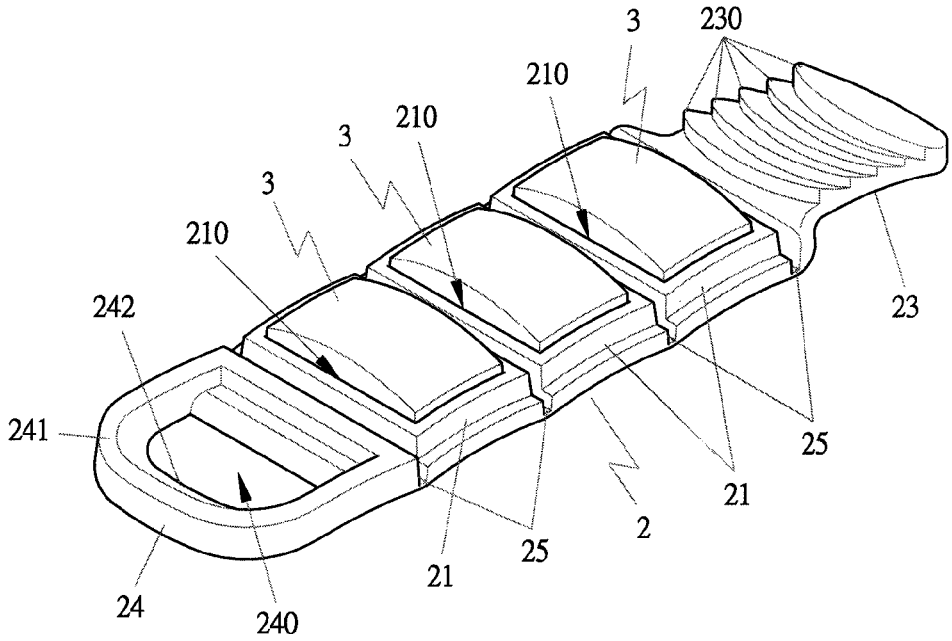
FIG. 7 is a perspective view of the first embodiment of a bobby pin in the present invention.
Figure 8:
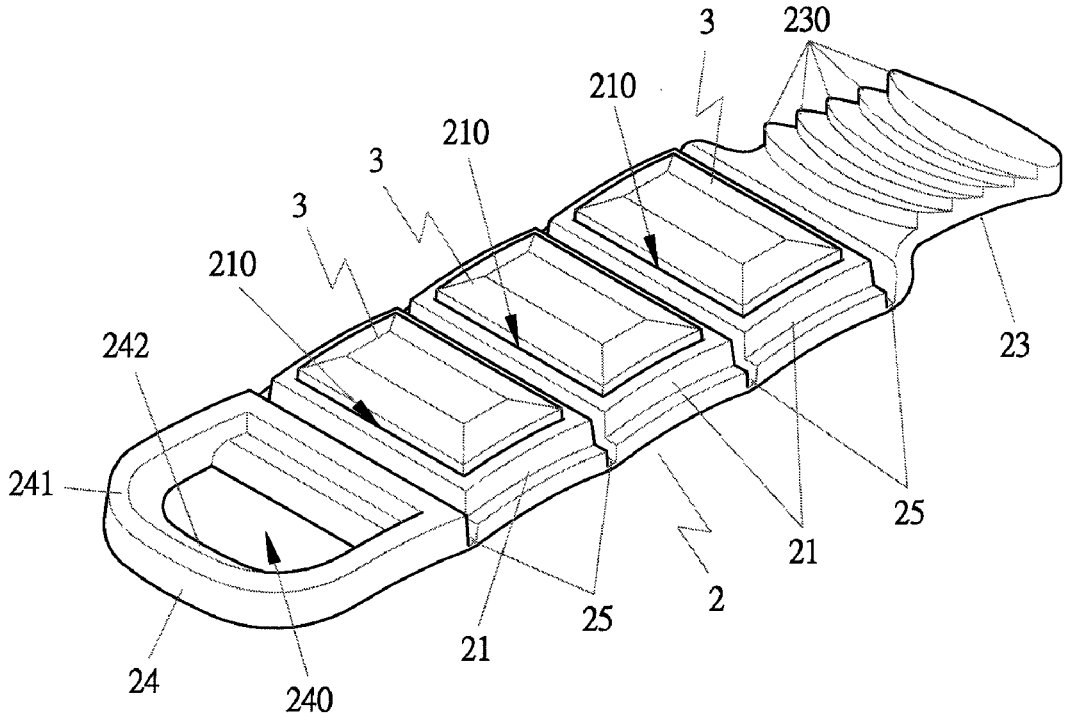
FIG. 8 is a perspective view of a second embodiment of a bobby pin in the present invention.
Figure 9:
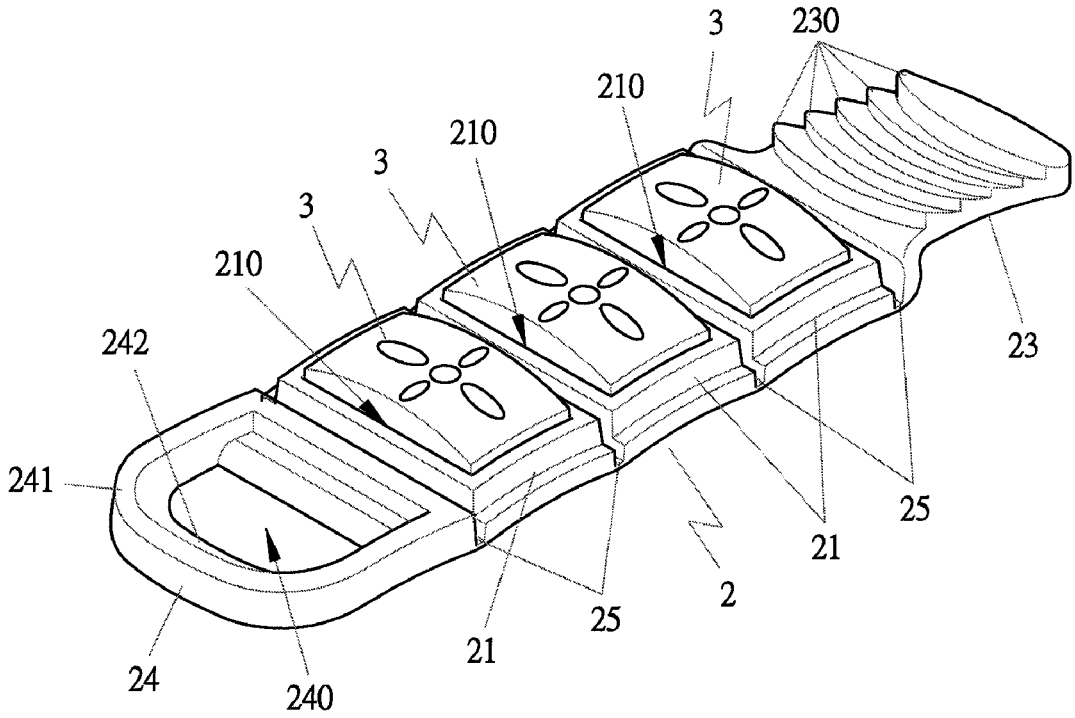
FIG. 9 is a perspective view of a third embodiment of a bobby pin in the present invention.
Figure 10:
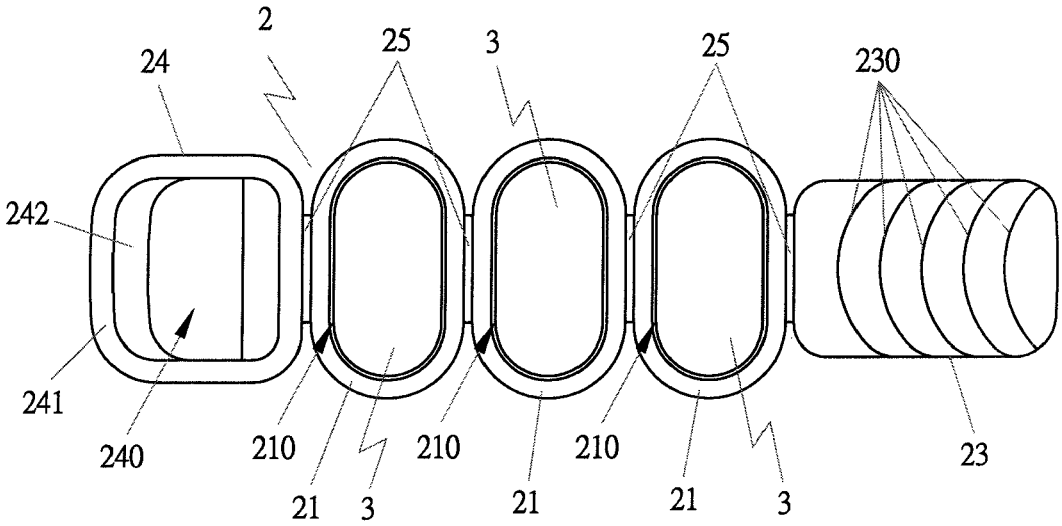
FIG. 10 is an upper view of a fourth embodiment of a bobby pin in the present invention.
Figure 11:
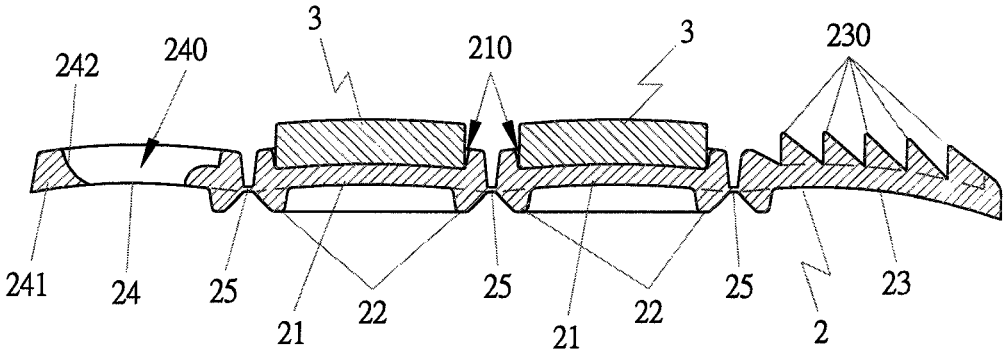
FIG. 11 is a cross-sectional view of a fifth embodiment of a bobby pin in the present invention.

A first embodiment of a bobby pin in the present invention, as shown in FIGS. 3, 4 and 5, includes a body 2, and plural decorations 3. The body 2 is composed of a decorative member 21, plural projections 22, a clamping member 23, a clamping holes member 24 and plural bending members 25.

Figure 12:
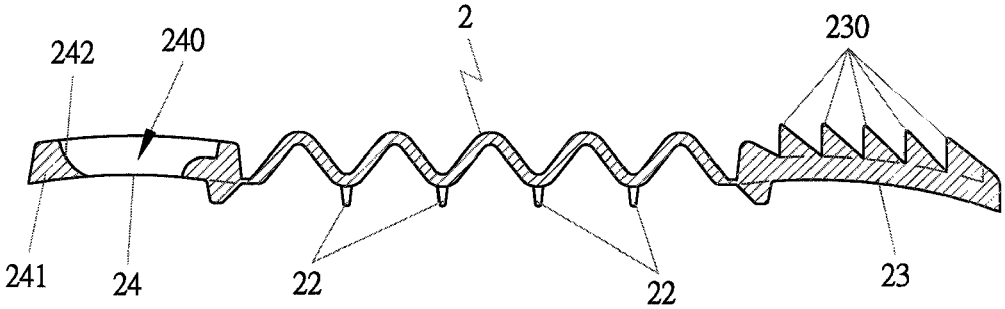
FIG. 12 is a cross-sectional view of a sixth embodiment of a bobby pin in the present invention.
Figure 13:
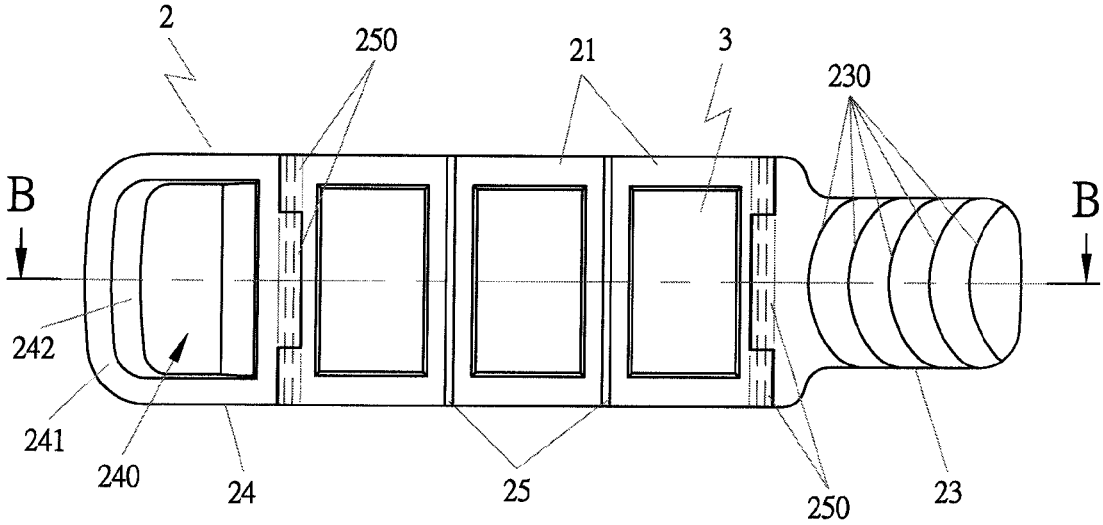
FIG. 13 is an upper view of a seventh embodiment of a bobby pin in the present invention.
Figure 14:
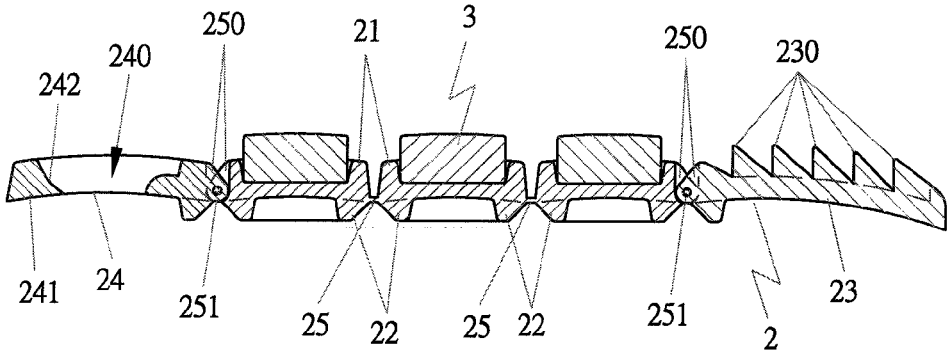
FIG. 14 is a cross-sectional view of the line B-B in FIG. 13.
Figure 15:
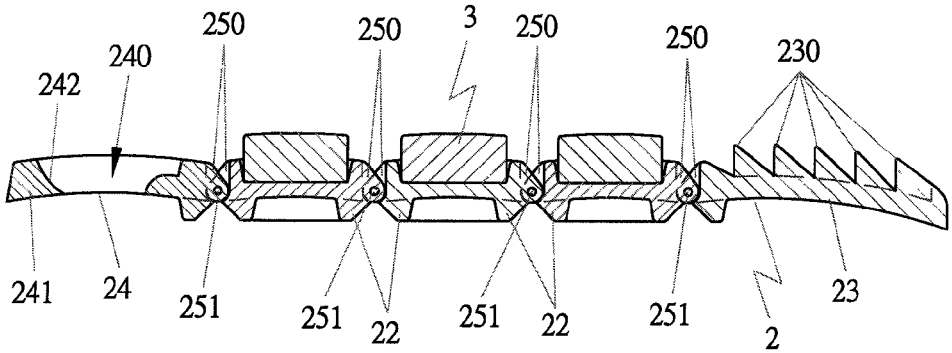
FIG. 15 is a cross-sectional view of an eighth embodiment of a bobby pin in the present invention.
Figure 16:
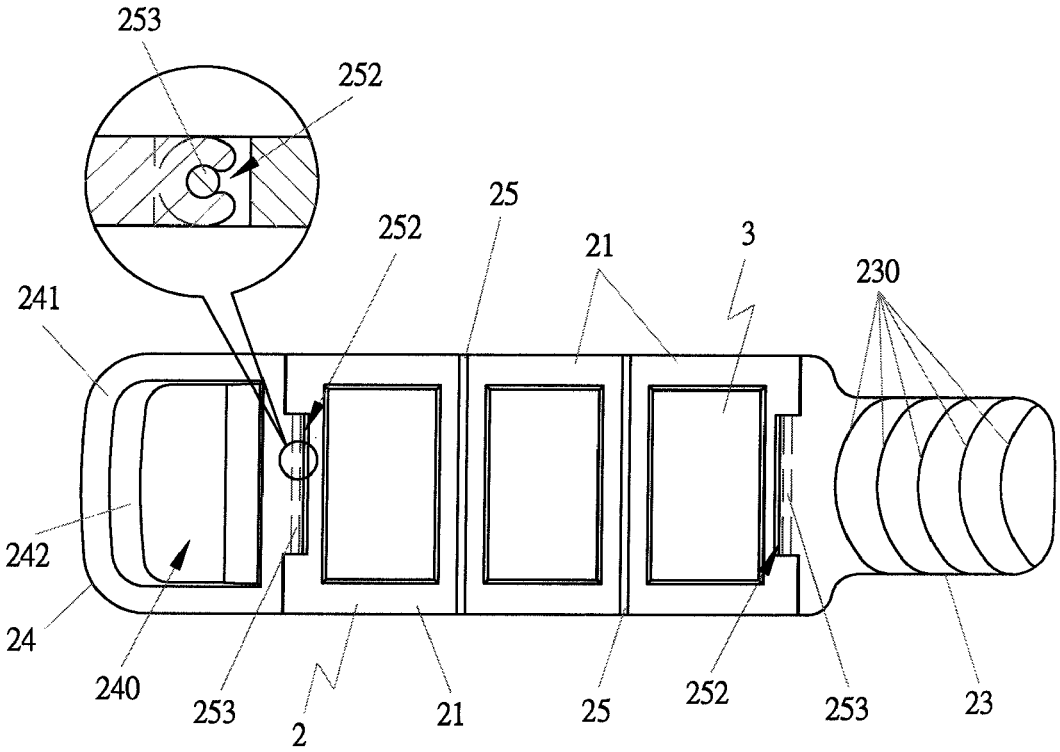
FIG. 16 is an upper and a partial cross-sectional view of a ninth embodiment of a bobby pin in the present invention.

The decorative member 21 is provided with plural decoration recesses 210 of any shape for the decorations 3 with the same shape and size as the recesses 210 to be positioned therein respectively, and FIGS. 6-10 show the first to the fourth embodiment having various shapes of the decorations 3 to be positioned in the decoration openings 210. Then a user can use any one of the decorations 3 personally and optionally. Moreover, the body 2 shown in FIG. 12 illustrating a sixth embodiment is shaped as continual waves. Then the projections or teeth 22 are formed to extend downward from the body and spaced apart equidistantly for helping clamp hair tightly.

Then the clamping member 23 is formed to connect to one side of the decorative member 21, provided with plural clamping teeth 230, and the clamping holed member 24 is formed to connect to the other side of the decorative member 21, provided with a clamping hole 240 and a clamping rim 241 around the clamping hole 240, and the clamping rim 241 provided with a sloped surface 242. The clamping member 23 is provided with plural continual clamping teeth 230. Thus, according to the various quantity of hair to be clamped by the bobby pin, the clamping condition of the clamping teeth 230 with the clamping rim 241 can be altered freely, improving the disadvantage of the conventional bobby pin.

The bending members 25 are formed integral with the body 2, located between the decorative member 21, the clamping member 23 and the clamping holed member 24, and the thickness of the bending members 25 is smaller than that of the body 2, so the whole body 2 or all of the decorative member 21, the clamping member 23 and the clamping holes member 24 are able to be bent to let the bobby pin become a tubular shape, as shown in FIG. 5. In this way, the bobby pin is still flexible, even if it is made of comparatively thick plastic.

The bending members 25 of the first embodiment are also used in the second, the third, the fourth and the fifth embodiment shown in FIGS. 6-11, but in the seventh and the eighth embodiment they are replaced with a shaft base 250 with a shaft 251 fitting therein. In the seventh embodiment the shaft base 250 is provided between the decorative member 21 and the clamping member 25 as well as between the decorative member 21 and the clamping holed member 24, and in the eighth embodiment they are provided between the decoration grooves 210 mutually, between the decorative member 21 and the clamping member 23 as well as between the decorative member 21 and the clamping holed member 24

Besides, the bending members 25 are replaced with plural shaft grooves 252 in the ninth embodiment between the decorative member 21 and the clamping member 23, and between the decorative member 21 and the clamping holed member 24, with a shaft 253 fitting in the shaft groove 252.

Figure 17:
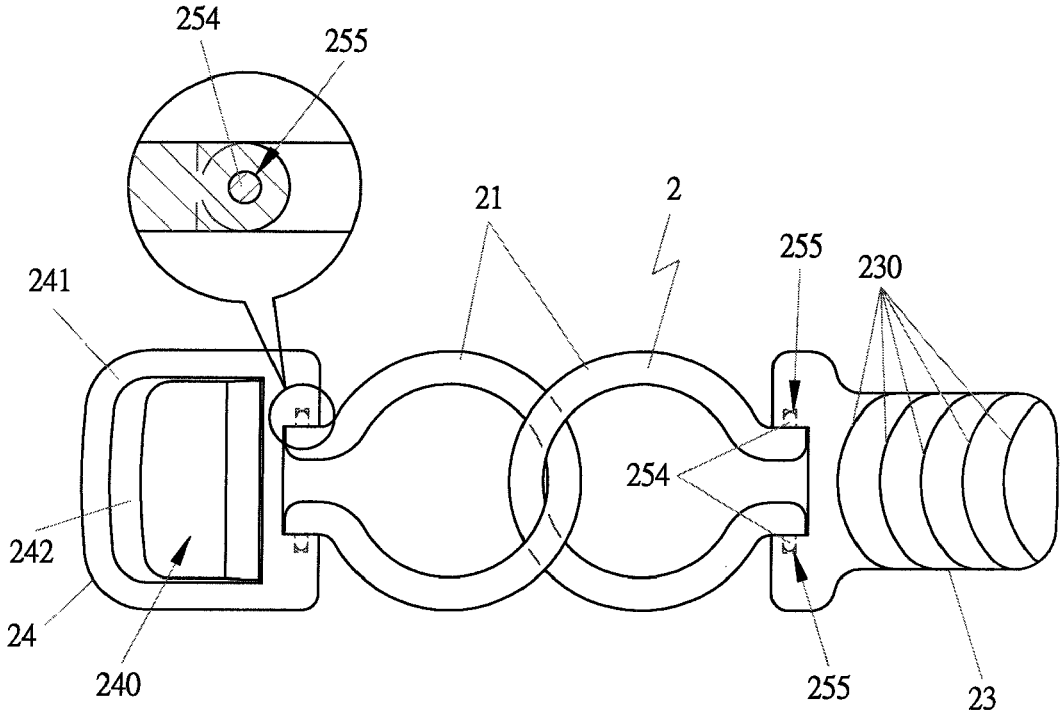
FIG. 17 is an upper and a partial cross-sectional view of a tenth embodiment of a bobby pin in the present invention.

Next, the tenth embodiment shown in FIG. 17 includes a body 2, a decorative member 21, a clamping member 23, and a clamping holed member 24 combined together. In this embodiment the decorative member 21 is composed of two separate rings intertwined with each other, and each ring is provided with a cut opening, and a shaft projection 255 formed sidewise outward at two ends of the opening. So the outer end of each ring can be combined with the clamping member 23 and the clamping holed member 24 by means of the shaft projections 255 respectively, permitting the body 2 bendable to form a tubular shape for clamping hair. Thus the shaft projections 255 replace the bending members 25 of the first embodiment.

Figure 18:
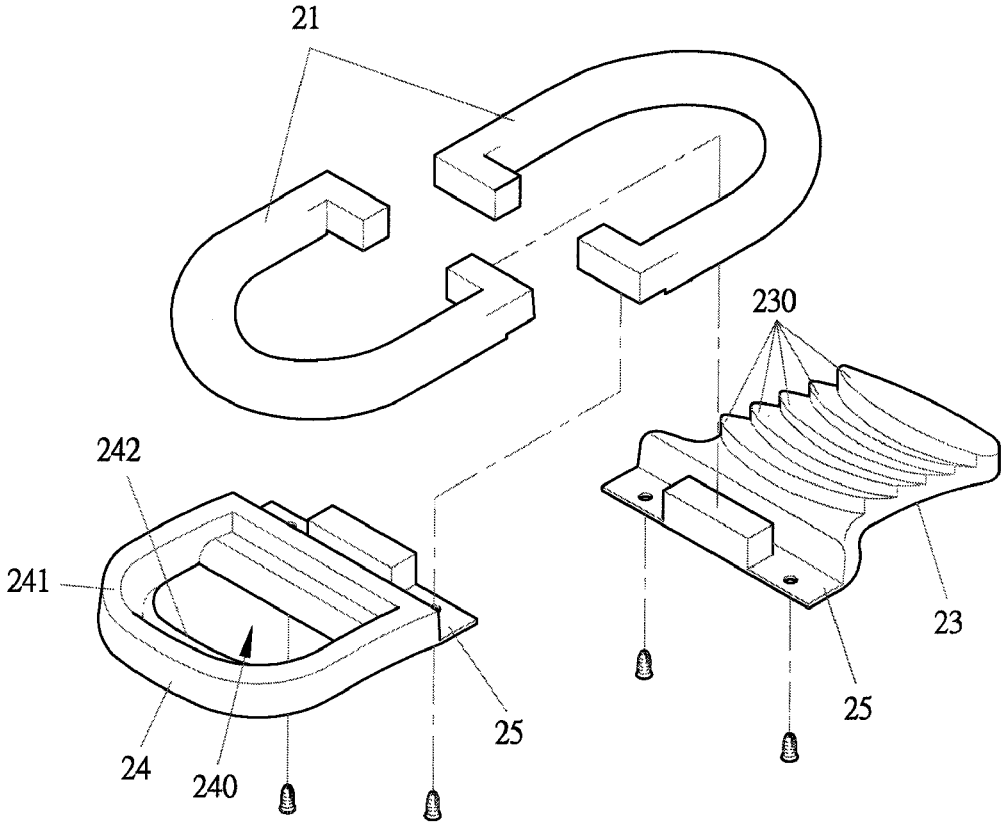
FIG. 18 is an exploded perspective view of an eleventh embodiment of a bobby pin in the present invention.
Figure 19:
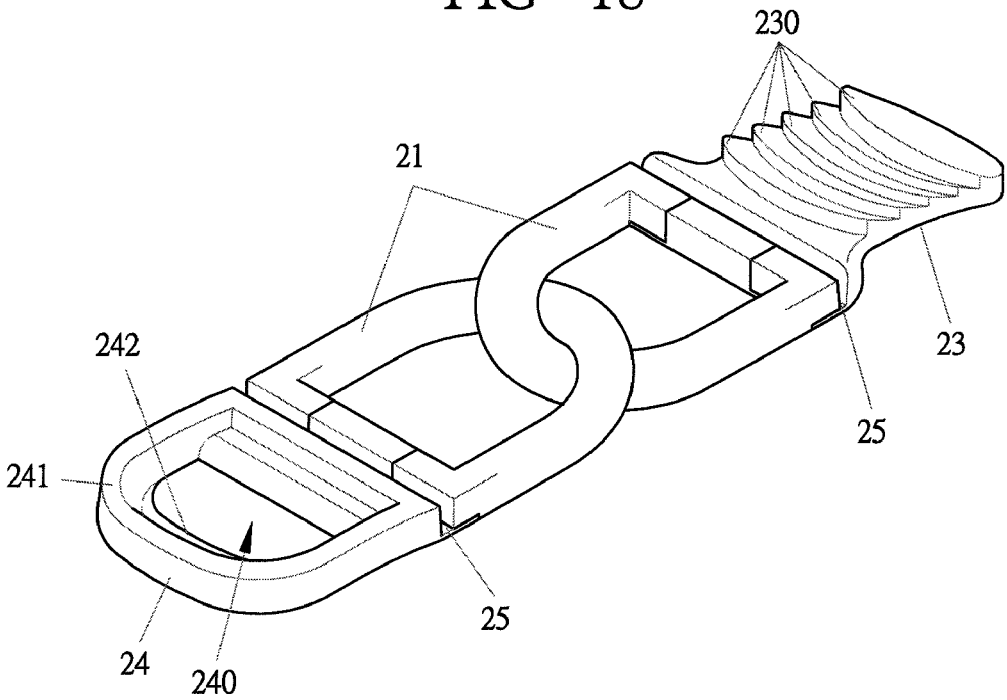
FIG. 19 is a perspective view of a twelfth embodiment of a bobby pin in the present invention.

The decorative member 21 of the body 2 in the eleventh and the twelfth embodiment shown in FIGS. 18 and 19 is made independent from the clamping member 23 and also from the clamping holed member 24, composed of plural U-shaped decorations. Then fastening members 4 such as screw can be used to combine the decorative member 21 with the clamping member 23 and also with the clamping holes member 24.

Figure 20:
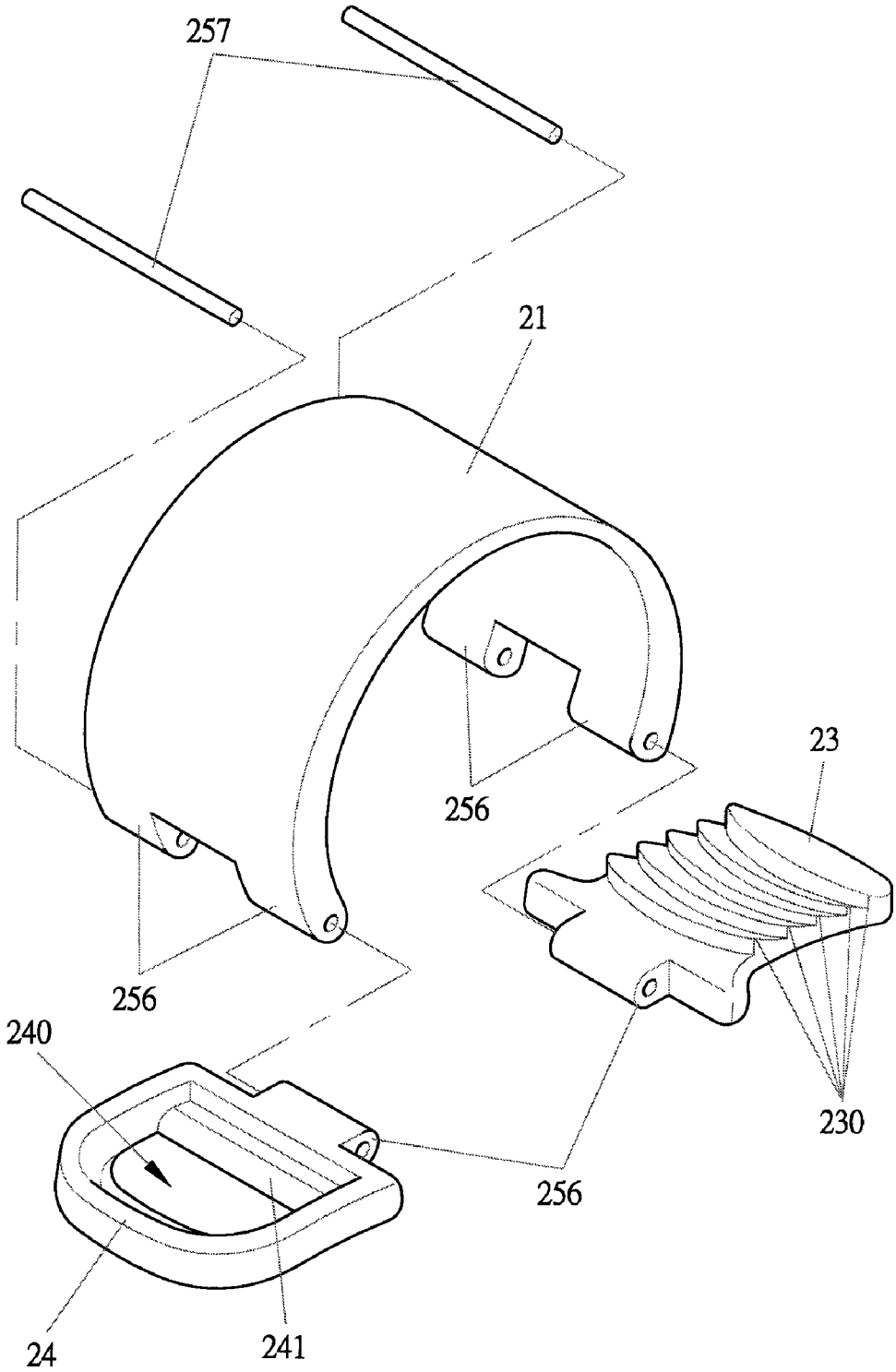
FIG. 20 is an exploded perspective view of a thirteenth embodiment of a bobby pin in the present invention; and, FIG. 21 is a perspective view of a bobby pin in a used condition in the present invention.
Figure 21:
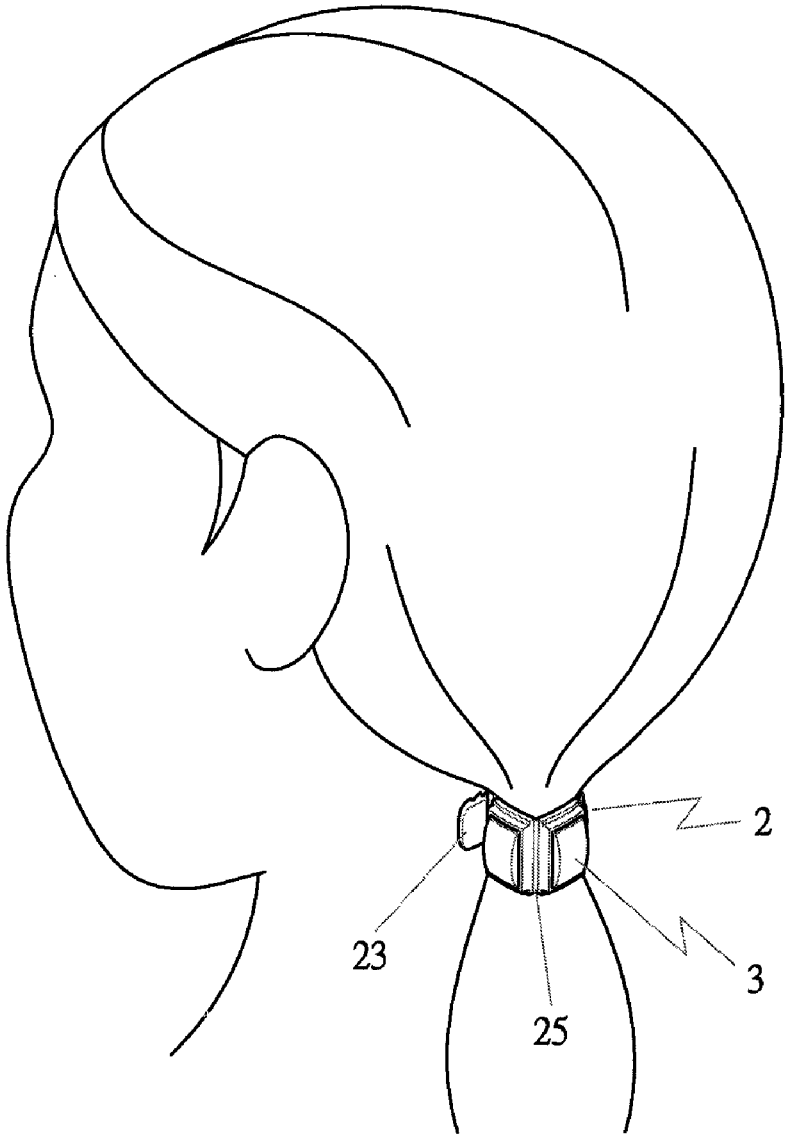

The decorative member 21 of the body 2 in the thirteenth embodiment shown in FIG. 20 is a semi-tubular decoration. The thirteenth embodiment is composed of the decorative member 21, a clamping member 23 and a clamping holed member 24, and the decorative member 21 is formed with a shaft base 256 with a shaft hole at two side ends. Then the clamping member 23 and the clamping holed member 24 are respectively provided with a shaft base 256 with a shaft hole for a shaft 257 to fit through. So the shaft base 256 at the right side of the decorative member 21 is fitted together with the clamping member 23 in a line for the shaft 257 to be extended in both the shaft holes of the two shaft bases 256 to function as a pivot to permit the clamping member 23 bendable relative to the decorative member 21. Then the shaft base 256 at the left side of the decorative member is fitted together in a line with the shaft hole of the clamping holed member 24 for the shaft 257 to be extended in both the shaft holes of the two shaft bases 256 to function as a pivot to permit the clamping holed member 24 bendable relative to the decorative member 21 so that the bobby pin may be bent to become a tubular shape for clamping hair.

The decorative member 21 in the tenth, the eleventh the twelfth and the thirteenth embodiment is adjacent to the clamping member 23, which is provided with the plural teeth 230. In order to correspond to the clamping member 23, the clamping holed member 24 is provided at the other side of the decorative member 21, formed with the clamping hole 240 with the clamping rim 241 with the sloped surface 242. As there are the plural clamping teeth 230, the clamping condition of the clamping teeth with the clamping rim 241 is able to be altered in several ways to suit to the quantity of hair to be clamped by the bobby pin.

By the way, the tenth and the eleventh embodiment shown in FIGS. 17 and 18 can also have the clamping member 23, the clamping holed member 24 and the bending members 25 made integral as one piece, with the bending members 25 located equidistantly between the decorative member 21 and the clamping member 23, and also between the decorative member 21 and the clamping holed member 24. As the bending members 25 are thinner than that of the body 2, enabling the decorative member 21, the clamping member 23 and the clamping holed member 24 easily bent to permit the whole body 2 become a tubular shape as shown in FIG. 5, so the bobby pin is possible to bent, even it is made of comparatively thick plastic.

In general, the bobby pin of any embodiment in the invention can perform tightly clamping hair operation by means of the clamping member 23 clamping the clamping rim 242 with one of the plural teeth 230 of the clamping member 23, suiting to the various quantity of hair to be clamped, While the preferred embodiments of the invention have been described above, it will be recognized and understood that various modifications may be made therein and the appended claims are intended to cover all such modifications that may fall within the spirit and scope of the invention.

What is claimed is:

1. A bobby pin comprising:

A body provided with a plurality of decorative members, arranged in series, each of said decorative member provided with a decoration recess, said body further provided with a clamping member extending outward from one end of said plurality of decorative members, said body further provided with a clamping holed member extending outward from the other end of said plurality of decorative member, said clamping holed member bored with a clamping hole and a clamping rim around said clamping hole, said body further provided with plural bending members, wherein one bending member is located between every two neighbouring decorative members, between said plurality of decorative members and said clamping member, and between said plurality of decorative members and said clamping holed member, respectively, so that said body can be bent to become a tubular shape, characterized in that said bending members have a thickness smaller than that of said decorative members, each of the decoration recesses has a bottom wall and includes a decoration fitted stably therein, said clamping member is formed with plural clamping teeth each for alternatively clamping with said clamping rim for hair to pass through the bobby pin with various quantity of hair, each decorative member has a sloped projection or tooth extending downward from the bottom wall of each decoration recess thereof for helping clamp hair tightly.

2. The bobby pin as claimed in claim 1, wherein said decoration recesses are of any shape.

3. The bobby pin as claimed in claim 1, wherein said decorations are of any shape and appearance.

4. The bobby pin as claimed in claim 1, wherein that bending member that is located between said plurality of decorative members and the clamping member, and that bending member that is located between said plurality of decorative members and the clamping holed member are respectively composed of a shaft bases with a shaft hole and a shaft fitting in said shaft hole.

5. The bobby pin as claimed in claim 1, wherein all bending members are respectively composed of a shaft base with a shaft hole and a shaft fitting in said shaft hole.

6. The bobby pin as claimed in claim 1, wherein said that bending member that is located between said plurality of decorative members and the clamping member, and that bending member that is located between said plurality of decorative members and the clamping holed member are respectively composed of a shaft groove and a shaft fitting in said shaft groove.

7. The bobby pin as claimed in claim 1, wherein that bending members that is located between said plurality of decorative members and the clamping member, and that bending member that is located between said plurality of decorative members and the clamping holed member are respectively composed of a shaft hole formed in the neighbouring decorative member and a shaft formed on said clamping member and on said clamping holed member, respectively, and said shaft of said clamping member and said clamping holed member fitting in said shaft hole of the decorative member.

8. The bobby pin as claimed in claim 1, wherein those bending members that are located between said plurality of decorative members are formed integrally with adjacent decorative members.

9. The bobby pin as claimed in claim 8, wherein that bending member that is located between said plurality of decorative members and the clamping member, and that bending member that is located between said plurality of decorative members and the clamping holed member are formed integrally with said clamping member and the adjacent decorative member and with said clamping holed member and the adjacent decorative member, respectively.

10. The bobby pin as claimed in claim 1, wherein each decorative member has two sloped projections or teeth extending downward from the bottom wall of each decoration recess thereof and positioned at two opposite ends of the decoration member along a longitudinal direction of the bobby pin, and said two sloped projections or teeth are integrally formed with said bottom wall.

* * * * *